US006764411B2

(12) United States Patent
Knox

(10) Patent No.: US 6,764,411 B2
(45) Date of Patent: Jul. 20, 2004

(54) PORTABLE MODULAR INDOOR/OUTDOOR GOLF PRACTICE APPARATUS

(76) Inventor: John Knox, 750 Ludlow, Rochester, MI (US) 48307

( * ) Notice: Subject to any disclaimer, the term of this patent is extended or adjusted under 35 U.S.C. 154(b) by 0 days.

(21) Appl. No.: 09/990,612

(22) Filed: Nov. 21, 2001

(65) Prior Publication Data

US 2003/0096657 A1 May 22, 2003

(51) Int. Cl.[7] ..... A63B 69/36

(52) U.S. Cl. ..... 473/162; 473/172; 473/175; 473/181

(58) Field of Search ..... 473/150–171, 473/181, 175

(56) References Cited

U.S. PATENT DOCUMENTS 1,612,292 A * 12/1926 Jackson ..... 473/181
2,515,847 A * 7/1950 Winkler ..... 428/17
3,610,631 A * 10/1971 Mulherin ..... 473/181
3,735,988 A * 5/1973 Palmer et al. ..... 473/162
3,743,295 A * 7/1973 Flowers ..... 473/171
3,762,718 A * 10/1973 Culley ..... 473/160
3,885,795 A * 5/1975 Brewer ..... 473/165
5,042,813 A * 8/1991 Huang ..... 473/153
5,171,016 A * 12/1992 Kamal ..... 473/160
5,366,224 A * 11/1994 Stanwyck et al. ..... 473/162
5,662,531 A * 9/1997 Durso ..... 473/278
5,848,940 A * 12/1998 Yamada ..... 473/157
5,916,034 A * 6/1999 Lancia ..... 473/157
6,302,803 B1 * 10/2001 Barlow ..... 473/162

* cited by examiner

*Primary Examiner*—Mark S. Graham

(57) ABSTRACT

An indoor/outdoor, portable, modular practice golf simulation apparatus that can be modified to be used as a putting green or driving mat. The apparatus includes a plurality of modular frame pieces that are coupled together to form a frame. These modular frame pieces may be unitary structures or urethane foam supported structures. A golf simulation surface having varying length and color simulation grass is attached to the frame to allow for use as a putting green or a driving mat. A plurality of cups, with or with ball clearing ducts, may be molded in the frame pieces to provide a wide variety of golf practice situations.

21 Claims, 5 Drawing Sheets

PORTABLE MODULAR INDOOR/OUTDOOR GOLF PRACTICE APPARATUS

BACKGROUND

1. Field of Invention

The present invention relates to golf practice apparatus and more particularly to a modular golf practice apparatus that can be used indoors or outdoors and is easily portable.

2. Description of Prior Art

Many devices have been developed for improving ones skill in putting. These devices are typically heavy, unimaginative, and for use indoors only.

For example, U.S. Pat. Nos. 1,904,034, 2,539,046, 3,944,232 4,240,637, 4,611,809, 4,634,130, 4,877,250, 4,978,127, 5,002,280, 5,069,455, 5,102,141, 5,171,016, 5,123,651, 5,390,925, 5,441,266, 5,445,381, and 5,505,451 have similar and related flaws. Many are square in shape and very dissimilar to any natural putting green. In some, the player stands in a fixed position at one end of the apparatus and putts towards the opposite end. Devices of this nature are not real in appearance or operation and not very interesting to practice on so practice becomes boring and thus not beneficial.

U.S. Pat. Nos. 1,904,034, 4,240,637, 4,611,809, 4,978,127, 5,002,280, 5,069,455, 5,123,651, 5,390,925, 5,441,266, 5,445,381 each use a series of levers, screws, or adjustable legs to change the contour of the putting surface. These items are cumbersome to operate and add considerable weight and expense to the apparatus.

U.S. Pat. No. 5,441,265 is round, but the player stands in a fixed position. The series of air bladders which are used to change contour adds considerable weight making the apparatus stationary.

Along similar lines, artificial grass mats have been used for years at golf driving ranges for use with golf clubs other than putters to practice longer shots. These mats are made with materials similar to artificial putting greens, and are beneficial to prevent turf wear and tear that is typical at most driving ranges. These grass mats having a section of grass to stand on and a separate section to hit the golf ball. Recent improvements have modified these mats to have a sandy base such that a golf tee may be stuck into them.

The putting greens as described above suffer from many similar problems. First, they are cumbersome to build and operate. Second, devices of this nature are not real in appearance or operation. Third, these devices typically may only be built to one shape and thus are not very interesting on which to practice. As such, practice becomes boring and not beneficial.

It is highly desirable to design an indoor/outdoor golf practice surface that overcomes many of the above deficiencies.

SUMMARY OF THE INVENTION

Accordingly, a principle desirable object of the present invention is to provide a golf practice apparatus that overcomes some or all of the disadvantages of the prior art devices.

Another object of the present invention is to provide a golf practice apparatus that looks like a real natural putting green in color and shape.

Yet another object of the present invention is to provide a golf practice apparatus on which the player may putt from various positions and can move about the surface constantly changing lengths and direction of putts as a golfer would move about a natural putting green.

Still another object of the present invention is to provide a golf practice device that may be played outdoors in warm weather and indoors during inclement weather. The frame, playing surface, structure support and cups are entirely weatherproof.

A further object of the present invention is to provide a golf practice apparatus that is interesting to play.

A still further object of the present invention is to provide a golf practice apparatus that is easy to operate.

An additional object of the present invention is to provide a golf practice apparatus that is lightweight and easily portable.

Yet another additional object of the present invention is to provide a golf practice apparatus that can be economically manufactured and be durable in nature.

A still additional object of the present invention is to provide a golf practice apparatus which uses real regulation practice green cups and cup markers.

A further object of the present invention is to provide a golf practice apparatus on which the player can chose continuous uninterrupted putting practice through a ball clearing duct located in at least one cup.

Yet a further object of the present invention is to provide a golf practice apparatus that can be adjustable to match the contours of real natural putting greens.

Another object of the present invention is to provide a putting surface on the golf practice apparatus that can be changed, substituted or replaced if necessary.

Yet another object of the present invention is to provide a modular practice apparatus that is easily interchangeable between a putting green and a driving surface by simply changing the configuration and grass length.

These and other objects are achieved by the disclosed golf practice apparatus. The golf practice apparatus has a plurality of modular, rigid portable subpieces that can be easily connected to form a putting green in a plurality of different sizes and shapes. The frame in a preferred embodiment is supported by a lightweight plastic material and has a simulated grass surface that is attached to the frame allowing a person to stand on the frame and putt or hit a golf ball. A plurality of golf cups may be located in the surface of the golf practice apparatus allowing for putting in any direction. Various contours can also be placed on the surface allowing for a user to practice putts with different breaks. In addition, the length of the simulated grass surface may be modified from very short, for use as a putting green, to longer, where it is used as a driving mat.

These and other desirable objects and advantages of the present invention will in part appear hereinafter and will in part become apparent after consideration of the specification with reference to the drawings and ensuing description.

DETAILED DESCRIPTION OF THE PREFERRED EMBODIMENTS

Figure 1:
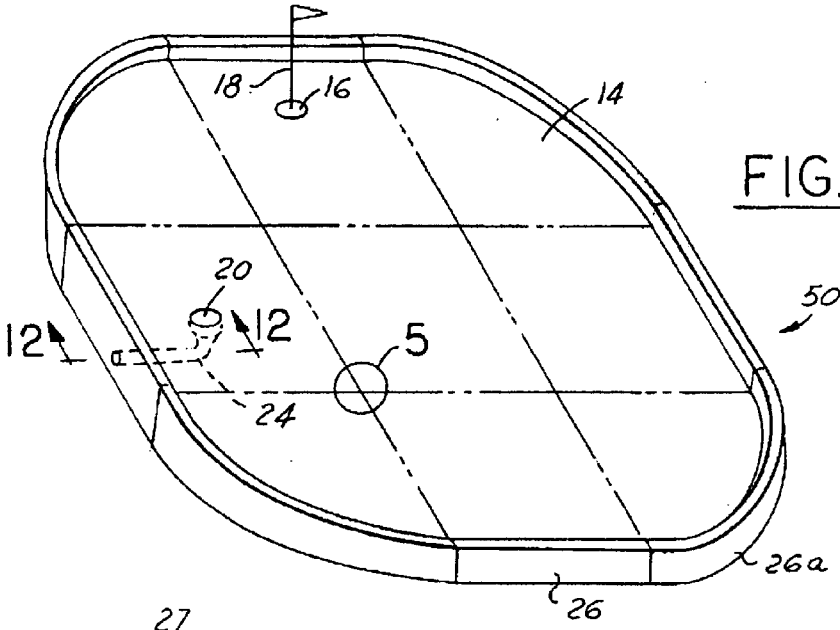
FIG. 1 is a perspective view of a modular golf practice apparatus constructed in accordance with a preferred embodiment of the present invention.

Referring now to FIG. 1, there is illustrated a golf practice apparatus indicated generally by the numeral 50. The golf practice apparatus 50 includes a frame, generally designated by the reference numeral 23, that preferably is supported with hardening urethane foam (shown as 17, in FIGS. 7 and 8) that provides structure support to golf practice apparatus 50. However, the frame may also be a unitary structure that is designed to be self-supporting without a hardening urethane foam. The frame 23 is preferably comprised of multiple frame pieces 27. A golf simulation surface 14 is provided over the frame pieces 27. The apparatus 50 may contain one or more circular cups 20 formed therein. One or more of these cups 20 may have a ball clearing duct 16 associated therewith. Cups 16 and 20 are preferably regulation practice green cups outfitted with removable cup markers 18 including fiberglass rod, flag and ball lifter. Any number of cups 20 can be included in any number of locations. A raised trim piece 26, or edge, is provided around the outer periphery of the golf practice apparatus 50.

As best shown in FIGS. 1. and 2A, a trim piece 26 is depicted having t-type protrusions and is secured to the outer frame pieces 27 to form a continuous outer boundary. Of course, in alternative arrangements, the trim piece 26 may have u-shaped notches 31. The trim piece 26 preferably measures not more than 2.54 cm above the golf simulation surface 14 and functions to keep putted balls from rolling or falling off the golf practice apparatus 50. It should be understood that the trim piece 26 can extend more or less than 2.54 cm from the puffing surface and can be removed entirely, especially when the practice apparatus is being used as a practice hitting surface. As best shown in FIGS. 1 and 6A, an additional curved corner trim piece 26*a* is secured to each corner frame piece 15.

Figure 2:
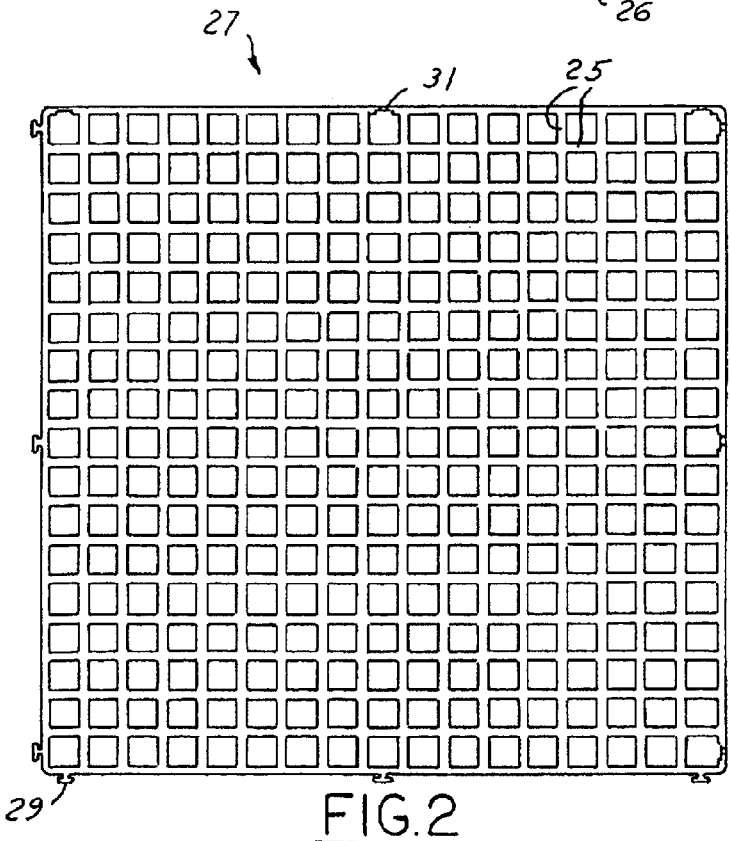
FIG. 2 is a top view of a modular frame piece according to a preferred embodiment of the present invention.
Figure 2A:
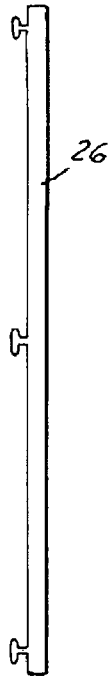
FIG. 2A is a side view of a portion of FIG. 2.

FIGS. 2–4 and 4A illustrate a modular frame piece 27 that is preferably molded or vacuum-formed from a plastic weatherproof material by methods that are well known in the art, induding, for example, injection molding or vacuum forming. However, other non-plastic weatherproof materials and manufacturing techniques as are known in the art may be used to form the frame pieces 27. Each frame piece 27 is preferably sized approximately four feet wide by four feet long, or approximately equal to the size of a standard moving pallet. Also, each frame piece 27 is designed to be lightweight for ease of installation. Each frame piece 27 also has a plurality of vertical and horizontal support slats 25 that give enhanced structural support. The number and thickness of each slat 25 as depicted in FIG. 2 is a function of the amount of support needed to support the weight of an individual or individuals using the apparatus 50.

Figure 3:
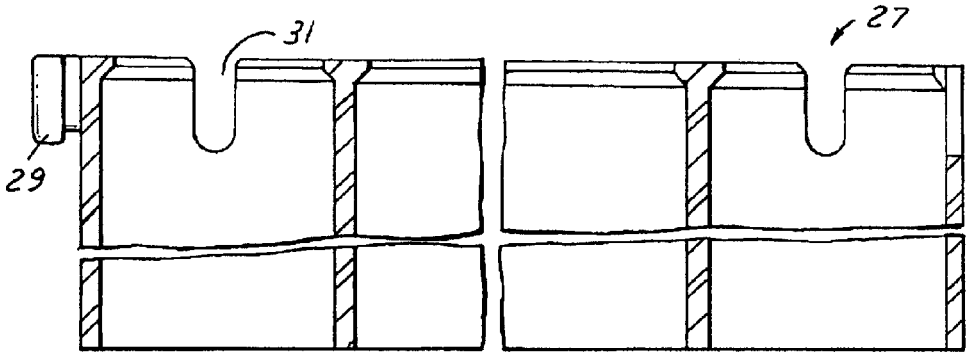
FIG. 3 is a side view taken along line 3—3 of FIG. 2.
Figure 4:
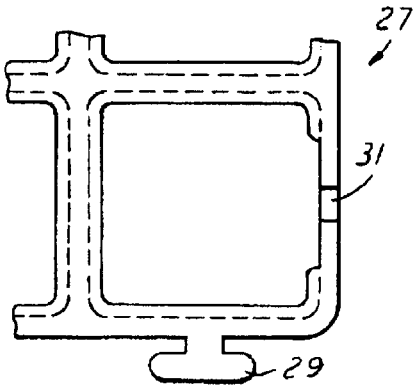
FIG. 4 is an enlarged view of a portion of FIG. 2.
Figure 4A:
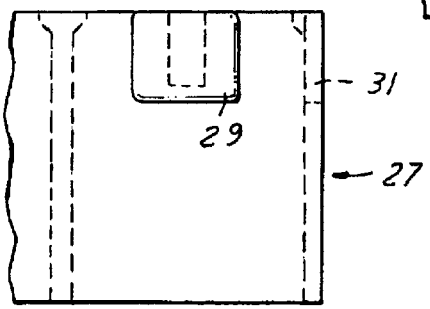
FIG. 4A is a side view of the enlarged portion of FIG. 4.
Figure 9:
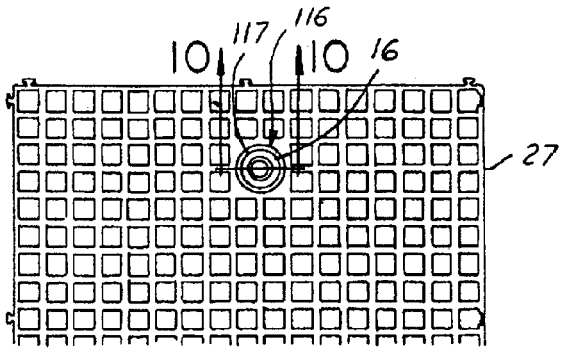
FIG. 9 is a top perspective view of a modular frame piece having a hole formed therein in accordance with a preferred embodiment of the present invention.

As best seen in FIGS. 3, 4 and 4A, each frame piece 27 has a plurality of t-shaped protrusions 29 extending from two sides of the frame piece 27 and a plurality of u-shaped notches 31 extending from the other two sides. The number of t-shaped protrusions 29 and u-shaped notches 31 are equal along an individual side of the frame piece 27. The location and configuration of the protrusions 29 and notches 31 can obviously vary.

Figure 5:
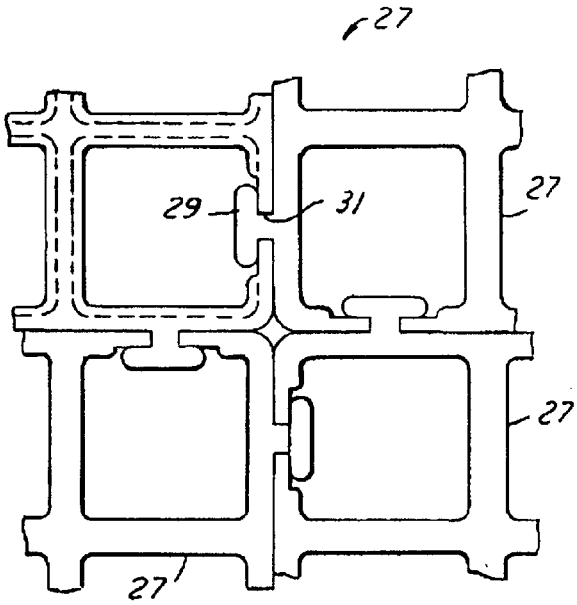
FIG. 5 is a top view illustrating four modular frame pieces as in FIG. 1 interconnected to form a frame in accordance with the present invention.

As seen in FIG. 5, to attach adjacent frame pieces 27 to form a frame 23, the t-shaped protrusions 29 are inserted within the u-shaped notches 31 to interlock the two adjacent frame pieces 27. Of course, the number of t-shaped protrusions 29 and u-shaped notches 31 may vary depending upon the interlocking characteristics desired for the golf practice apparatus 50, but preferably approximately two to five protrusions 29, 31 are sufficient along each side of the frame piece 27 to ensure adequate locking.

Figure 6:
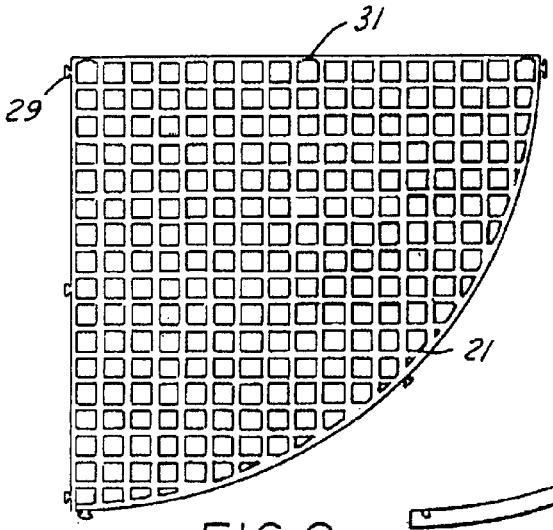
FIG. 6 is a top perspective view of a modular corner frame piece in accordance with the present invention.
Figure 6A:
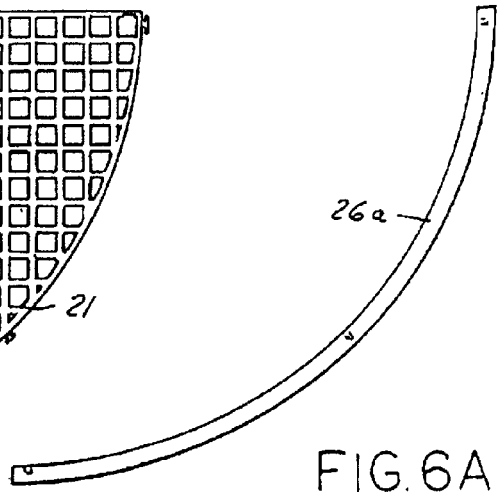
FIG. 6A is a top perspective view of a curved trim piece for use with the modular corner frame piece of FIG. 6.

Referring now to FIG. 6, a corner frame piece 15 for use along the outer periphery of the golf practice apparatus 50 is depicted. Corner frame piece 15 is preferably contoured along side 21 and can contain t-type protrusions 29, as depicted here, or u-type notches 31, to interlock with an adjacent frame piece 27. The shape of the side 21 may vary, but is typically rounded so as to more closely resemble the shape of a rounded, natural-looking putting green.

FIG. 6A depicts a corner trim piece 26*a* that is countered to match that of the side 21. The corner trim piece 26*a* has either t-shaped protrusions 29 or u-shaped notches 31 to secure the corner trim piece 26*a* to the corner frame piece 15 in a manner similar to the way trim piece 26 is secured to frame piece 27.

Frame pieces 27, 15 are preferably manufactured of High Density Polyethylene (UDPE) and molded into present form by any accredited vacuum forming company using known vacuum forming methods. In the preferred embodiment, the frame pieces 27, 15 have a length and width of approximately four feet each such that the frame pieces 27, 15 may easily be transported on a pallet. Corner frame pieces 15 preferably are sized to have a length and width similar to that of the frame pieces 27 and have a countered side 21 that is preferably smooth and continuous. The corner frame pieces 15, when placed horizontally, preferably lie 15.24 cm above the floor or ground. However, the dimensions disclosed herein are merely illustrative as the dimensions may be changed and are a matter of design choice. The dimensions can be changed and are only constrained by the portability of apparatus 50.

Figure 7:
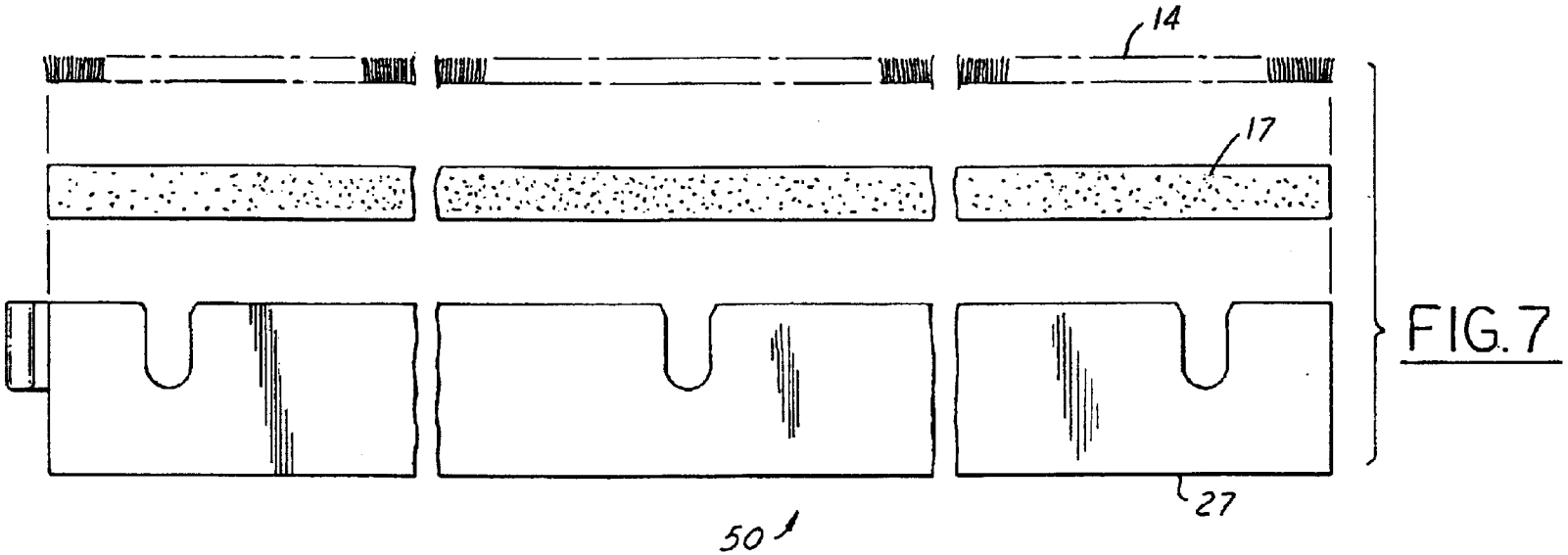
FIG. 7 is an exploded side view of FIG. 1 taken alone line 7—7.
Figure 8:
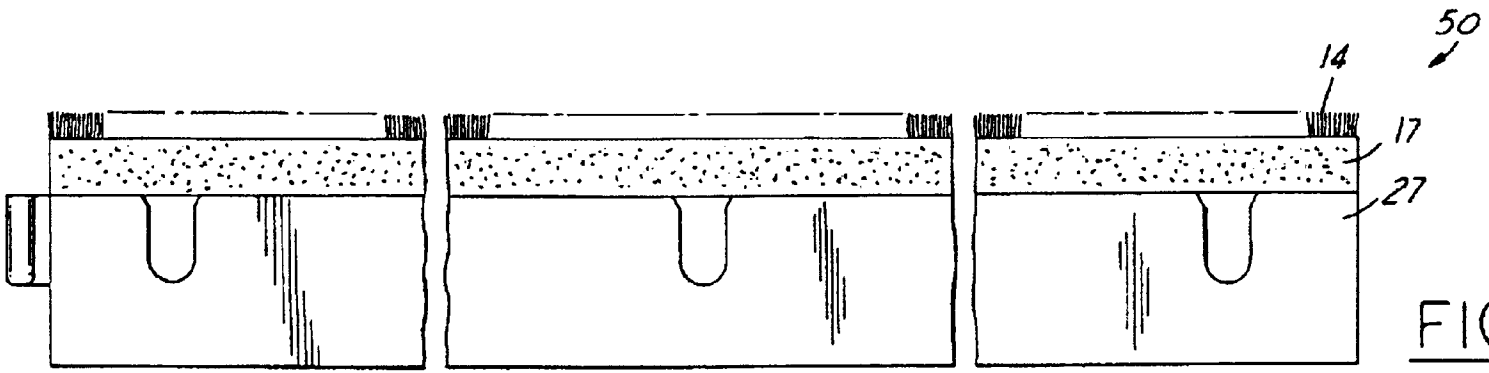
FIG. 8 is a side view of FIG. 1 taken along line 7—7.
Figure 11:
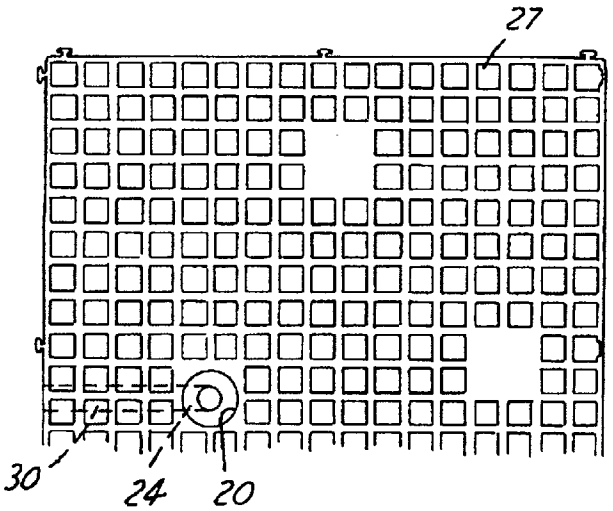
FIG. 11 is a top perspective view of a modular frame piece having a hole with a ball-clearing duct.
Figure 13:
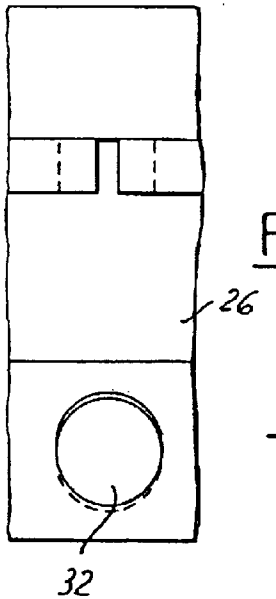
FIG. 13 is a side view of FIG. 12 taken along line 13—13.

As seen in FIGS. 7 and 8, to help support the frame 23, a layer of urethane foam 17 is sprayed on top of the frame pieces 27, 15. This urethane foam 17 adheres to top surface of the frame piece 27, 15 and hardens to form a continuous structure. The golf simulation surface 14 is then laid on top of the urethane foam surface 17 to form the practice apparatus 50. In an alternative arrangement (not shown), this urethane foam 17 may be sprayed within the interior defined by the horizontal and vertical slats 25.

Golf simulation surface 14 is carpet, preferably all weather indoor/outdoor 100% ultraviolet stabilized BCF Olefin Manufactured by Intertex Carpet Mills or simulated grass manufactured by Putting Greens International, American Golf and Recreation, AmTurf or other simulated grass manufacturer. These simulated grasses are made of tough plastic materials such as nylon or polypropylene. The density of these grasses may be varied by experimentation to accommodate sand for impactability as is well known in the art. The surface 14 may be rolled out and secured to the frame 23 using a two-sided tape, a hook and loop fastener device, or some other type securing device well known in the art.

One problem with currently available simulated greens is that the grass used on the greens does not look natural in terms of color or texture as compared to outdoor putting greens and driving teeboxes. To remedy this, the current invention contemplates the use of a combination of evergreen and forest green colored simulated nylon or polypropylene simulated grasses to produce a golf simulation surface 14 having a grass coloring and tweed-like appearance simulating the look of a putting green found on a golf course. Preferably, this combination is approximately fifty percent evergreen and fifty percent forest green, however the actual percentages may vary to more accurately match the color in a particular region or to meet a customer preference.

Referring again to FIGS. 7 and 8, the height H of the golf simulation surface 14, may be varied between a lower height, an intermediate height, and a higher height depending upon how the golf practice apparatus 50 is used. For example, a lower height golf simulation surface 14 is preferable for indoor putting, while a higher height is preferable for an outdoor teebox used for driving, as a regulation golf tee may be placed into the surface 14. The lower height simulates the surface of a putting green and is preferably slightly higher than approximately zero inches. The higher height is used when the apparatus 50 is simulating shots from the rough of golf courses and is preferably approximately one inch high. The intermediate height simulates hitting off a fairway or light rough on a golf course and is approximately one-half to three-quarters of an inch in height, therein being high enough to accommodate a one and one-half inch tee. The surface 14 may also have sand placed within the grass surface for impactability and for the ability to secure a golf tee.

As best seen in FIGS. 9–12, the frame pieces 27 may be molded with a cup 16, a cup 20, or neither a cup 16 or cup 20 formed therein. Cup 16 and cup 20 are preferably regulation practice green cups that measure 10.16 cm high and 10.8 cm wide. However, in alternative embodiments, the height and width of these cups 16, 20 may be varied. In addition, corner frame piece 15 may be molded similarly to the frame piece 27 as having a cup 16 or cup 20.

Putting green cup 20 also has an attached ball clearing duct 24 having a tunnel 30. The ball clearing duct 24 is preferably made of PVC components measuring at least 5.08 cm in diameter. The ball clearing duct 24 functions to allow a putted golf balls that enters cup 20 to clear cup 20 by excavating through a tunnel 30 and emerging out the side of golf practice apparatus 50 through exiting hole 32 of trim piece 26 through gravity. Tunnel 30 and exiting hole 32 are larger than a golf ball. Of course, corner frame piece 15 may be molded similarly to the frame piece 27 to have a ball-clearing duct 24 as in FIGS. 9–13. Similarly, corner trim piece 26*a* may contain an exiting cup 32 similar to trim piece 26.

Figure 10:
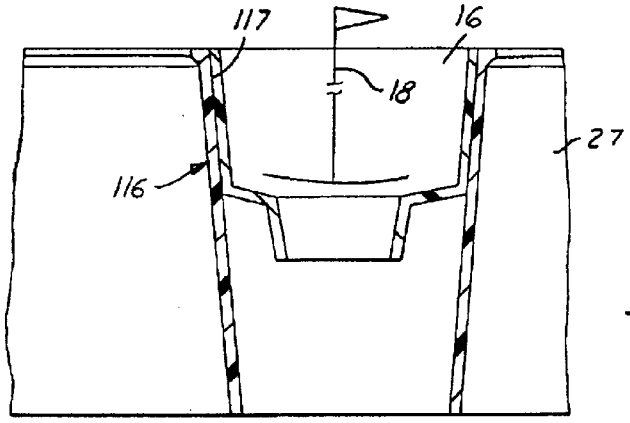
FIG. 10 is a side view of a portion of FIG. 9 taken along line 10—10.
Figure 12:
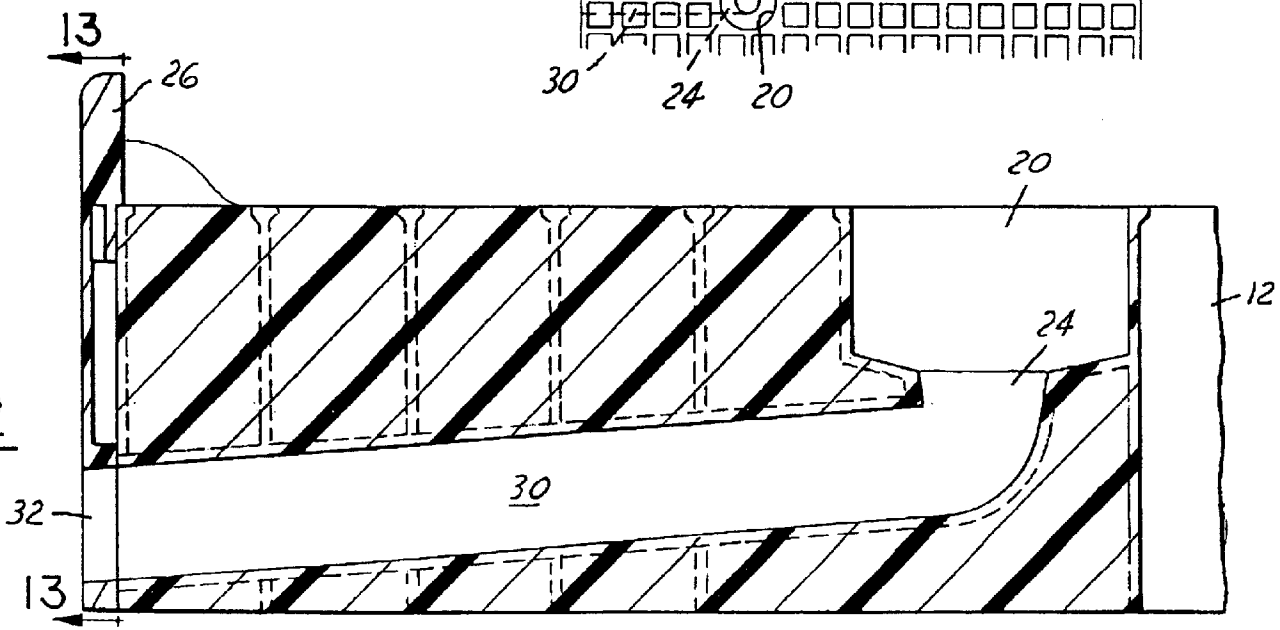
FIG. 12 is a side view of FIG. 10 taken along line 12—12.

Also shown on FIGS. 10 and 12 is a cup marker 18. The cup marker 18 may be placed in the cup 16 or cup 20 to lift balls putted into cup 16 20. Cup markers 18 consist of a cast iron base, fiberglass rod and plastic flag.

Referring now to FIG. 12, to enhance pulling practice by varying the surface characteristics of the golf simulation surface 14, the frame piece 27, or the frame piece 15, may be attached within the apparatus 50 that are pre-molded with contours 28. The player can thus practice putts that break by positioning balls near the contour 28. The contour 28 will allow a player to simulate breaking putts encountered on real natural putting greens. The contour 28 is merely illustrative of the contours or undulations that can be formed in the frame pieces 27, 15. These contours 28 can be formed such that the player can practice left to right breaks, right to left breaks, uphill putts, downhill putts, or any combinations.

In addition, the apparatus 50 has a plurality of plugs (not shown) that are sized to fit in existing cups 16, 20 and other holes that are precut in the surface 14 so that the cup 16, 20 locations can be changed as necessary or desired. This helps to ensure variety of putting opportunities available for a user. Further, when the user chooses to use the apparatus as a driving mat, these plugs help to ensure a continuous surface 14 on which to practice.

Operation

During use of the apparatus as a putting green, a player stands on golf simulation surface 14 and will move about the apparatus 50 hitting golf balls toward cups 16 or 20. When the player misses the cup 16, 20, the golf ball is prevented from falling off the apparatus 50 by the trim piece 26. Cup markers 18 are left in cups 16 and 20 when the player wishes to use a cup marker to lift balls out of cup. Cup markers 18 are taken out of cup 20 when the player wishes to activate ball clearing duct 24 for uninterrupted practice. The player can practice putts that break by positioning balls near contour 28. Contour 28 will allow player to simulate breaking putts encountered on real natural putting greens. Contour 28 is merely illustrative of the contours or undulations that can be formed in the surface. These contours can be formed such that the player can practice left to right breaks, right to left breaks, uphill putts, downhill putts, or any combinations.

Alternatively, when the golf practice apparatus 50 is set up as a driving mat, a player simply places a golf ball anywhere on the simulated grass surface 14 and swings. To ensure a continuous surface 14, a plug (not shown) is placed within each and every cup 16, 20. In this embodiment, the trim pieces 26, 26*a* are either removed around the outer periphery or sized such that it does not extend above the upper surface of the golf simulation surface 14. The length of the grass simulation surface 14 may be varied between the intermediate height and higher height described above so as to simulate real world golfing lies. This is accomplished by simply replacing the entire surface 14 or a portion of the surface with a longer length or shorter length grass surface.

When the season changes and the player decides to move golf practice apparatus 50 indoors or outdoors, he simply uncouples the simulated surface 14 from the frame 23, unlocks the frame pieces 27, 15 from each other and the trim pieces 26, 26*a*, carries the various pieces from inside to outside or vice versa, and reassembles the golf practice apparatus 50 as desired.

Golf practice apparatus 50 accomplishes each of the noted objects of the invention and solves many of the limitations existent in the prior art. Specifically, the apparatus 50 allows a user to move about the surface 14 choosing different lengths and directions from which to practice. The ability to constantly change stance, length and angles make the apparatus 50 more interesting to conduct practice sessions.

Another benefit is the ability to move the apparatus 50 easily between indoors and outdoors. This is accomplished by simply disassembling and reassembling the various pieces as described above.

A further benefit of the apparatus 50 is all-weather durability. Each piece of the apparatus 50 has the capability to withstand rain, snow, sun, heat and cold. The apparatus 50 can be used or left unattended outdoors for extended periods of time without harm.

In one embodiment, the apparatus 50 allows a user to putt uninterrupted without leaving the putting stance with the ball clearing duct feature 24.

To enhance putting practice by varying the surface characteristics of the golf simulation surface 14, the frame pieces 27, 15 may be attached within the apparatus 50 that are pre-molded with contours 28. Convenience and simplicity is enhanced because of the lack of levers, screws, adjustable legs or other moving parts to change the contour 28 of the golf simulation surface 14.

The materials used in the apparatus 50 manufacture are readily available and easy to procure. Therefore, the apparatus 50 is more affordable to golfers who wish to practice their golf game. Further, operating costs are effectively nonexistent because no power supply is necessary.

Regular use of the apparatus 50 by a golfer has the desirable effect of increasing such golfer's skill level, thereby reducing the final golf score.

Although specific features of this invention are shown in some drawings and not others, this is for convenience only as some features may be combined with any or all of the other features in accordance with this invention. The present invention has been described with reference to the preferred embodiment illustrated in the attached drawing figures, it is noted that substations may be made and equivalents employed herein without departing from the scope of the invention as recited below.

For example, the frame pieces 27, 15 may be constructed of wood, carbon or kevlar composites, Styrofoam loadboard other loadbearing foam, nylons or other lightweight plastics. The golf simulation surface 14 could be any carpet, felt, or synthetic grass surface. The cups 16, 20 could be any cup-like circular device. Because of the modular design, the invention may be any size or shape as to allow transport indoors and outdoors. The frame 23 could be any color. The golf simulation surface 14 could be any color. The cup markers 18 could be any color. The cup placements are randomly placed on the golf simulation surface 14. The cup 16, 20 placements may be moved. The invention could have handles to augment lifting and carrying invention. Moreover, to assist in the transport of the golf practice apparatus 50, wheels can be attached to the frame 23 allowing for movement thereof. Wheel locks would then also be provided to keep the apparatus 50 stationary when a user is using the apparatus 50.

When assembled, the plastic frame 23 may includes a plurality of drain holes formed in its bottom for draining. The top surface of the frame can be of any contour, including flat to entirely sloped. Additionally, the shape of the apparatus 50 can be of any shape, including rectangular or kidney shaped.

At least one golf cup 16, 20 may be molded into a frame piece 27 for receipt of a golf ball. The top surface of the frame piece 27 and urethane foam 17 is designed to receive a golf simulation surface 14 such as described above. The simulated surface 14 is designed to be attached to the frame pieces 27, 15 and/or urethane foam 17 by Velcro. However, any conventional attachment apparatus may be used.

In the preferred embodiment, the cup 16 is designed to float in order to compensate for shrinkage in the plastic due to temperature changes or other effect. The cup 16 is preferably set in a sleeve (shown as 116 in FIGS. 9 and 10) to allow for about ¼" give or play. In other words, there is a space (shown as 117 in FIGS. 9 and 10) between the outer surface of the cup 16 and the inner surface of the sleeve to accommodate for expansion of the cup 16 or shrinkage of the sleeve.

Thus the scope of the invention should be determined by the appended claims and their legal equivalents, rather than by the examples given.

What is claimed is:

1. A modular golf practice apparatus comprising:

a frame having at least one inner modular frame piece, each of said at least one inner modular frame pieces having four sides, wherein each of said at least one inner modular frame piece has at least one protrusion along each of two sides and at least one notch that are shaped to match said at least one protrusion along each of the other two sides;

wherein each side of said at least one inner modular frame piece is capable of being coupled to another of said at least one inner modular frame piece by inserting one of said at least one protrusion within a corresponding adjacent one of said at least one notch; and a golf simulation surface secured over said frame, said golf simulation surface comprising a grass-like material having a first height wherein at least one hole is molded within said frame, wherein each of said at least one hole has a corresponding cup being positioned within a sleeve laced within said hole such that said cup can float with respect to said sleeve to allow for shrinkage or expansion of said at least one cup due to temperature changes, said cup being set in said sleeve to allow for about one-quarter inch of play between said sleeve and said cup.

2. The modular golf practice apparatus of claim 1, wherein said frame also has at least one corner frame piece, each of said at least one corner frame piece having a first side having either at least one protrusion or at least one notch, a second side having at least one protrusion or at least one notch, and a countered side having at least one protrusion or at least one notch, wherein each of said at least one corner frame piece is coupled to an outer one of said plurality of modular frame pieces.

3. The modular golf practice apparatus of claim 2, wherein an interior region of said at one inner modular frame piece and said at least one corner frame piece is filled with a thermosetting urethane foam.

4. The modular golf practice apparatus of claim 2 further comprising a layer of a thermosetting urethane foam placed on top said at least one inner modular frame piece and said at least one corner frame piece.

5. The modular golf practice apparatus of claim 1 further comprising a trim piece coupled around the outer periphery of said frame, said trim piece having either at least one protrusion or at least one notch.

6. The modular golf practice apparatus of claim 2 further comprising:

a trim piece coupled around the outer periphery of said frame, said trim piece having either at least one protrusion or at least one notch; and a corner trim piece coupled to said countered side of each of said at least one corner frame piece, said trim piece having either at least one protrusion or at least one notch.

7. The modular golf practice apparatus of claim 6, wherein the height of said trim piece and said corner trim piece extends not more than 2.54 inches above the upper horizontal surface of said secured golf simulation surface.

8. The modular golf practice apparatus of claim 1, wherein said first height is between approximately zero and approximately one and one-half inches in height extending above said frame, said first height being a function of a desired simulated golfing condition.

9. The modular golf practice apparatus of claim 1, wherein said grass-like material is comprised of at least two colors of a simulated polymer grass, said at least two colors blending to form a first color having a tweed-like appearance, said first color closely resembling the color of grass normally found on a golf course.

10. The modular golf apparatus of claim 1, wherein said cup is coupled to a trim piece hole located in said frame piece or in said corner frame piece by a ball clearing duct and a tunnel.

11. The modular golf apparatus of claim 1, further comprising at least one removable plug, wherein one of said at least one removable plug fits within one of said at least one cup to allow the number and location of said at least one cup on said golf simulation surface to be varied.

12. The modular golf apparatus of claim 2, wherein said frame has at least one contour formed thereon.

13. The modular golf apparatus of claim 2, wherein said golf simulation surface is secured to said frame by a hook and loop fastener device.

14. A method for forming a golf practice apparatus comprising the steps of:

molding at least one inner modular frame piece, wherein at least one of said at least one inner mold piece has a generally circular molded-in hole having a predetermined outer diameter formed on said top surface;

coupling one of said at least one inner modular frame piece to at least one adjacent one of said inner modular frame piece to form a frame, said frame having a top portion and an outer periphery;

coupling a layer of thermosetting urethane foam to said top portion of said frame;

coupling a sleeve having a predetermined inner diameter within each of said at least one molded-in hole;

coupling a molded-in cup within said sleeve such that said molded-in cup generally floats within said sleeve;

coupling at least one trim piece having a first height to an outer periphery of said frame and;

coupling a golf simulation surface having a second height and at least two colors to said top portion of said frame, wherein said first height and said second height are a function of the type of golf practice desired, said at least two colors blending to form a first color having a tweed-like appearance, said first color closely resembling the color of grass normally found on a golf course, wherein said golf simulation surface has at least one hole, one of said at least one hole is located directly above each of said molded-in cup.

15. The method of claim 14 further comprising the steps of:

molding at least one corner frame piece, said corner frame piece having a contoured outer side;

coupling one of said at least one corner frame piece to at least one outer one of said at least one modular inner piece, wherein said outer periphery of said frame herein includes said additional at least one of said at least one corner piece; and coupling a corner trim piece to each of said contoured outer side of said at least one corner frame piece.

16. The method of claim 14, further comprising the step of placing one plug within at least one of said molded-in cup.

17. The method of claim 14, wherein the step of coupling one of said at least one inner modular frame piece to at least one adjacent one of said inner modular frame piece comprises the step of coupling at least one t-type protrusion of one of said at least one inner modular frame piece to a u-type notch of at least one adjacent one of said inner modular frame piece to form a frame, said frame having a top portion and an outer periphery.

18. The method of claim 15, wherein the step of coupling one of said at least one corner frame piece to at least one outer one of said at least one modular inner piece comprises the step of coupling at least one t-type protrusion one of said at least one corner frame piece to a u-type notch of at least one outer one of said at least one modular inner piece, wherein said outer periphery of said frame herein includes said additional at least one of said at least one corner piece.

19. The method of claim 14, wherein the step of coupling a golf simulation surface having a second height and a first color to said top portion of said frame comprises the step of coupling a golf simulation surface having a second height and a first color to said top portion of said frame with a hook and loop fastener device.

20. The method of claim 14, wherein the step of coupling at least one trim piece having a first height to an outer periphery of said frame comprises the step of coupling at least one t-type protrusion of at least one trim piece having a first height to a u-type notch on an outer periphery of said frame or coupling at least one u-type notch of at least one trim piece having a first height to a t-type protrusion on an outer periphery of said frame.

21. The method of claim 15, wherein the step of coupling a corner trim piece to each of said contoured outer side of said at least one corner frame piece comprises the step of coupling each of at least one t-shaped protrusion of said countered outer side to a corresponding one of at least one u-shaped notch on said corner trim piece or coupling each of at least one t-shaped protrusion of said corner trim piece to a corresponding one of at least one u-shaped notch on said contoured outer side.

* * * * *